US005520224A

United States Patent [19]

De Jager

[11] Patent Number: 5,520,224

[45] Date of Patent: May 28, 1996

[54] METHOD AND WEAVING MACHINE FOR MONITORING THE FELL POSITION FOLLOWING WEAVING OPERATION INTERUPTION

[75] Inventor: Godert De Jager, Benglen, Switzerland

[73] Assignee: Sulzer Rueti AG, Rueti, Switzerland

[21] Appl. No.: 397,530

[22] Filed: Mar. 1, 1995

[30] Foreign Application Priority Data

May 9, 1994 [EP] European Pat. Off. ..... 94810271

[51] Int. Cl.[6] ..... D03D 49/10; D03D 51/00

[52] U.S. Cl. ..... 139/1 R; 139/336

[58] Field of Search ..... 139/1 R, 336

[56] References Cited

U.S. PATENT DOCUMENTS

| | | | |
|---|---|---|---|
| 4,488,580 | 12/1984 | Sainen et al. | 139/336 |
| 4,546,801 | 10/1985 | Bucher et al. | 139/110 |
| 4,582,095 | 4/1986 | Kronholm | 139/1 R |
| 4,628,967 | 12/1986 | Osterle et al. | 139/1 R |
| 5,024,253 | 6/1991 | Kawabata et al. | 139/99 |

FOREIGN PATENT DOCUMENTS

| | | |
|---|---|---|
| 0136389 | 4/1985 | European Pat. Off. . |
| 0376338 | 7/1990 | European Pat. Off. . |
| 3435391 | 4/1985 | Germany . |
| 668997 | 2/1989 | Switzerland . |

*Primary Examiner*—Andy Falik
*Attorney, Agent, or Firm*—Townsend and Townsend and Crew

[57] ABSTRACT

The position of the fell of a cloth being woven on a weaving machine is sensed with a sensor needle that can be moved into and out of the cloth at a location proximate the fell during interruption of the weaving operation. Upon insertion of the sensor needle into the cloth, it moves with the cloth and therewith measures cloth displacement while the weaving machine is at rest. The sensor needle is attached to an actuation device capable of reciprocating the needle into and out of the cloth. The sensor needle is inductively coupled to a distance sensor which measures the needle displacement and therewith the displacement of the fell. In this manner, fell displacements caused, for example, by such factors as the relaxation of the run of cloth or of the warp yarn while the weaving machine is at rest can be measured and, before weaving is restarted, the position of the cloth, and therewith of the fell, can be corrected.

14 Claims, 1 Drawing Sheet

METHOD AND WEAVING MACHINE FOR MONITORING THE FELL POSITION FOLLOWING WEAVING OPERATION INTERUPTION

BACKGROUND OF THE INVENTION

The invention relates to a method and to an apparatus for sensing the fell position in a weaving machine, and also to a weaving machine having an apparatus of this kind.

Methods for sensing the fell position in a weaving machine are known. In these methods a sensor is for example displaced in the warp direction and the fell position is determined by an output signal when the sensor has traversed the fell.

This method has the disadvantage that the sensing takes place at a predetermined point in time and makes the assumption that the movement of the fell has been completed.

SUMMARY OF THE INVENTION

It is an object of the invention to improve a method for sensing the fell position by sensing the fell movement while the weaving machine is at rest.

This object is satisfied in accordance with the invention by interrupting weaving on the weaving machine and thereafter by moving a sensor into engagement with the cloth being woven. If, while the machine is at rest, the cloth becomes repositioned, the sensor member measures the displacement of the fell. A signal is then generated which is as a function of the measured fell displacement and the signal can be employed to correct the position of the fell on the machine before the machine is restarted.

All the movements of the fell are advantageously determined while the weaving machine is at rest, e.g. when correcting picking errors. Resetting the fell can take place directly and the weaving machine can subsequently be started.

The sensor member is advantageously inserted into the underside of the run of cloth because, by doing this, it is possible to place the sensor member inside the run of cloth with a minimal separation from the fell.

BRIEF DESCRIPTION OF THE DRAWINGS

The invention is described by means of example only with the aid of the enclosed figures.

DESCRIPTION OF THE PREFERRED EMBODIMENTS

Figure 1:
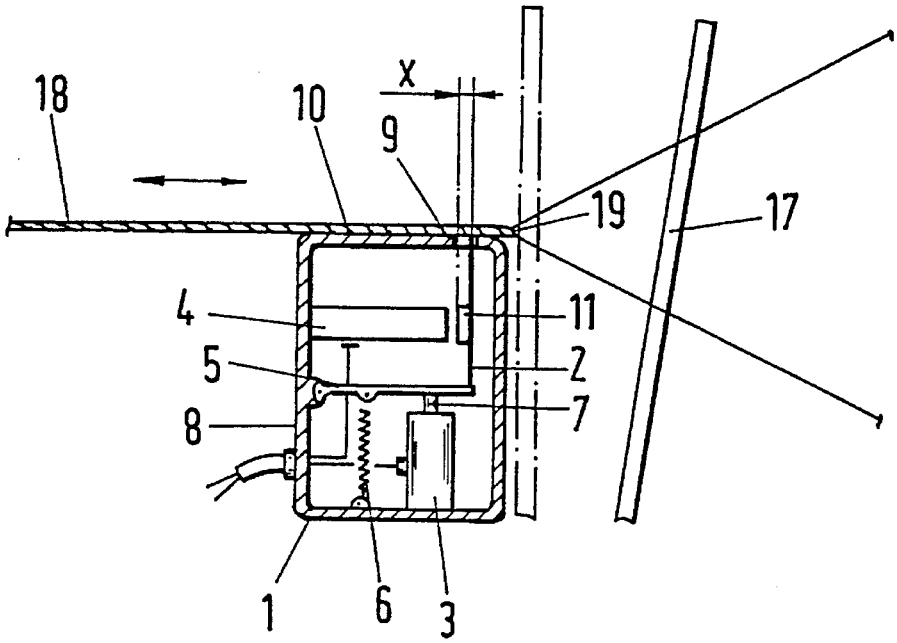
FIG. 1 is an elevational view, in section, of a first embodiment of an apparatus of the invention.

Referring to FIG. 1, a sensor needle 2, an electromagnet 3, an inductive distance sensor 4, a one-armed lever 5 and a tension spring 6 are arranged in a housing 1. The electromagnet 3 has an armature part 7. The lever 5 is hinged at one end at a housing wall 8 and lies on the armature part 7. The sensor needle 2 is secured at one end at the lever 5 and is guided in an elongate aperture 9 in a second housing wall 10. A member 11 is secured at the sensor needle 2 and cooperates with the distance sensor 4.

Figure 2:
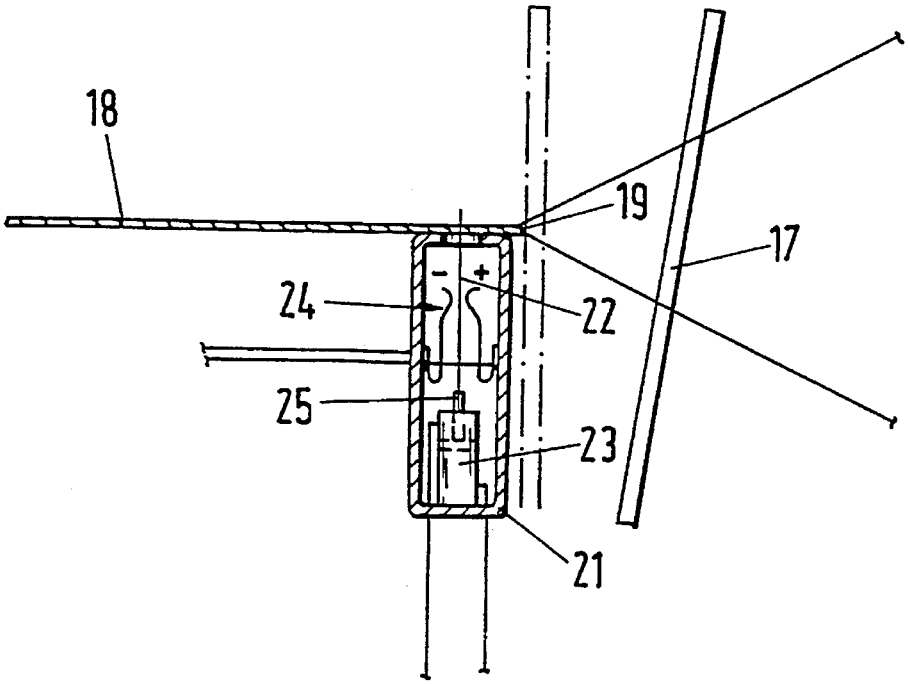
FIG. 2 is an elevational view, in section, of another embodiment of an apparatus of the invention.

Referring to FIG. 2 a sensor needle 23, a two-way compressed air cylinder 23 and a contact arrangement 24 are arranged in a housing 21. The pressure cylinder 23 has a piston 25 and is connected to a compressed air source (not shown) via two hose lines 26. The sensor needle 22 is connected at one end to the piston 25 and at the other end is guided in an elongate aperture 26 in a housing wall 27.

The contact arrangement has two contacts, the contact surfaces of which are arranged at a distance apart from one another. The sensor needle 22 is arranged between the contact surfaces, wherein the distances between the sensor needle and the contact surfaces is equal.

The weaving process may be interrupted as a result of faults occurring during operation of the weaving machine or due to running out of yarn for the weaving. The method described in the following is then initiated. When the weaving machine is switched off and thereby stopped as a result of an error signal arising from the weaving machine controller, the electromagnet 3 is energized and the armature part 7 is repelled. The lever 5 is thereby pivoted and the needle is driven into the run 18 of the cloth. The lateral excursion of the sensor needle is limited by the lateral surfaces of the elongate aperture which form a guide. The position of the sensor needle, which has been inserted into the run, in relation to the distance sensor is stored in the machine control as the zero position. While the weaving machine, is stopped the position of the fell changes due to various factors and processes. In such a case the tension of the cloth or fabric and of the warp yarn is maintained with appropriate tensioners such as backrest rollers as is well known to those skilled in the art. The effect of the tensioner and the inherent elasticity of the warp yarns and/or the fabric typically results in fell displacements while the weaving machine is at rest. Due to this change, the position of the sensor needle changes in relation to the distance sensor, for example by an amount X. Before restarting the weaving machine, the fell is displaced into its original position, which returns the sensor needle to its original or zero position as well. Together with the resetting of the fell, the previous operational condition re the run tension or warp tension is simultaneously regained. The machine control generates a start signal for the weaving machine and electromagnet 3 is de-energized so that the reset spring pulls the lever 5 back, thereby withdrawing the sensor needle 2 out of the run 18.

The apparatus is arranged in a weaving machine on the weaver's side in front of the reed 17 and below the run 18 in such a manner that the sensor needle 2, 22 can be inserted into the run 18 near the fell 19 (FIG. 1).

A particular advantage of the apparatus described is furthermore that this apparatus can be employed without difficulty in air weaving machines for which, as is known, the fell is covered over from the weft insertion channel during the catching of the weft yarn.

When operation is interrupted, a sensor needle 2 is inserted into the run 18 near the fell in order to sense the fell position and to determine the displacement of the fell 19 while the weaving machine is at rest. The sensor needle 2 is connected to an actuation device 3 in order to insert the sensor needle 2 into the run 18 and is inductively coupled to a distance sensor 3 in order to measure the displacement of the fell 19.

It is thus possible in a weaving machine to measure in an advantageous manner the displacement of the fell effected on the basis of various factors and processes, for example by intrinsic relaxation of the run of cloth and of the warp yarn while the weaving machine is at rest.

What is claimed is:

1. A method for sensing the position of a fell of a cloth being woven on a weaving machine comprising the steps of providing a sensor member; interrupting weaving on the weaving machine; thereafter moving the sensor member into engagement with the cloth being woven; with the sensor member measuring a displacement of the fell while weaving is interrupted; and generating a signal as a function of the fell displacement measured by the sensor member.

2. A method according to claim 1 wherein the step of moving comprises moving the sensor member from an underside of the cloth into engagement with the cloth.

3. A method according to claim 1 wherein the step of moving comprises the step of moving the sensor member into engagement with the cloth at a location proximate the fell.

4. A method according to claim 1 wherein the step of measuring comprises continuously sensing positional changes of the sensor members.

5. A method according to claim 1 wherein the step of measuring comprises sensing positional changes of the sensor members intermittently.

6. A method according to claim 1 including the step of using the signal as a display signal.

7. A method according to claim 1 including the step of using the signal for returning the fell to its original position.

8. Apparatus for sensing the position of a fell of a cloth being woven on a weaving machine comprising a sensor member operatively mounted on the machine, means coupled with the sensor member for moving the sensor member into and out of engagement with the cloth following an interruption of cloth weaving by the weaving machine, and a device operatively coupled with the sensor member for generating a signal which reflects a positional change of the sensor member while the sensor member is engaged with the cloth and resulting from a displacement of the cloth on the weaving machine while weaving is interrupted.

9. Apparatus according to claim 8 wherein the means for moving comprises a fluid activated cylinder.

10. Apparatus according to claim 8 wherein the means for moving comprises an electromagnet.

11. Apparatus according to claim 8 wherein the device comprises an inductive distance sensor.

12. Apparatus according to claim 8 wherein the device comprises a contact arrangement.

13. Apparatus according to claim 8 wherein the means for moving comprises a reset member for disengaging the sensor member and the cloth.

14. A weaving machine for weaving cloth including a fell and for sensing and correcting a position of the fell on the weaving machine while weaving is discontinued, the weaving machine comprising a sensor member operatively mounted on the machine, means coupled with the sensor member for moving the sensor member into and out of engagement with the cloth following an interruption of cloth weaving by the weaving machine, and a device operatively coupled with the sensor member for generating a signal which reflects a positional change of the sensor member while the sensor member is engaged with the cloth and resulting from a displacement of the cloth on the weaving machine while weaving is interrupted.

* * * * *

UNITED STATES PATENT AND TRADEMARK OFFICE

CERTIFICATE OF CORRECTION

PATENT NO. : 5,520,224

DATED : May 28, 1996

INVENTOR(S) : Godert De Jager

It is certified that error appears in the above-identified patent and that said Letters Patent is hereby corrected as shown below:

On the title page, item,

[54] In the title, change "INTERUPTION" to --INTERRUPTION--.

Signed and Sealed this

Sixth Day of August, 1996

*Attest:*

*Attesting Officer*

BRUCE LEHMAN

*Commissioner of Patents and Trademarks*